US010865573B2

(12) United States Patent
Verhaar

(10) Patent No.: US 10,865,573 B2
(45) Date of Patent: Dec. 15, 2020

(54) SYSTEM, APPARATUS AND METHODS FOR A HAND-HELD DRY WALL TAPE APPLICATOR

(71) Applicant: John Verhaar, Midway City, CA (US)

(72) Inventor: John Verhaar, Midway City, CA (US)

( * ) Notice: Subject to any disclaimer, the term of this patent is extended or adjusted under 35 U.S.C. 154(b) by 0 days.

(21) Appl. No.: 15/873,734

(22) Filed: Jan. 17, 2018

(65) Prior Publication Data

US 2019/0218798 A1 Jul. 18, 2019

(51) Int. Cl.

| | |
|---|---|
| ***E04F 21/02*** | (2006.01) |
| ***E04F 21/16*** | (2006.01) |
| ***E04F 21/165*** | (2006.01) |

(52) U.S. Cl.

CPC ..... *E04F 21/026* (2013.01); *E04F 21/163* (2013.01); *E04F 21/1652* (2013.01); *E04F 21/1657* (2013.01)

(58) Field of Classification Search

CPC ..... E04F 21/02; E04F 21/026; E04F 21/08; E04F 21/657; E04F 21/1652; E04F 21/16; E04F 21/161; E04F 21/162; E04F 21/163

See application file for complete search history.

(56) References Cited

U.S. PATENT DOCUMENTS

| | | | | |
|---|---|---|---|---|
| 2,858,953 | A * | 11/1958 | Harrell | E04F 21/165 156/575 |
| 2,876,730 | A * | 3/1959 | Moore | E04F 21/026 118/43 |
| 3,260,638 | A | 7/1966 | Hoveland | |
| 3,344,770 | A * | 10/1967 | Schaefer | B05D 1/18 118/122 |
| 4,080,240 | A | 3/1978 | Dysart | |
| 4,358,337 | A | 11/1982 | Johnson et al. | |
| 4,652,331 | A | 3/1987 | Plasencia | |
| 5,882,691 | A | 3/1999 | Conboy | |
| 6,907,908 | B1 * | 6/2005 | Weldy | E04F 21/165 118/404 |
| 7,766,065 | B2 * | 8/2010 | Verhaar | E04F 21/165 156/575 |
| 2001/0003563 | A1 | 6/2001 | Schauer | |
| 2009/0172952 | A1 * | 7/2009 | Hoover | E04F 21/32 30/169 |

* cited by examiner

*Primary Examiner* — Alex B Efta
(74) *Attorney, Agent, or Firm* — J. Curtis Edmondson; Law Offices of J. Curtis Edmondson

(57) ABSTRACT

A hand held combined tool for drywall taping including a drywall tape applicator attached to a smoothening blade is described. The dry wall tape applicator includes a gated protrusion for feeding a dry wall tape through a ridged slot and to be held securely in position by a user before dipping the dry wall tape in a joint compound container to coat the dry wall tape with the joint compound on both side of the dry wall tape. The user then pulls the dry wall tape through the gated protrusion and the ridged slot to obtain a uniformly dual side coated drywall tape ready to be placed on a joint and to be immediately smoothened with the smoothening blade attached to the dry wall tape applicator.

14 Claims, 7 Drawing Sheets

SYSTEM, APPARATUS AND METHODS FOR A HAND-HELD DRY WALL TAPE APPLICATOR

CROSS REFERENCES TO RELATED APPLICATIONS

This application claims the benefit of U.S. Provisional Patent Application No. 62/448,772, filed Jan. 20, 2017, entitled as "Drywall Compound To Tape Applicator", which is incorporated herein by reference in its entirety.

FIELD

The inventive subject matter relates to dry wall tape applicators, specifically to a hand held combined tool for drywall taping.

BACKGROUND

It is common in the construction industry to attach pre-manufactured gypsum boards to the underlying structural members of wall and ceilings of homes, offices, and other habitable structures to cover the walls and give a finished and smooth surface to apply paint or wallpaper. Typically, after attaching gypsum boards to the interior walls and ceilings of framing members with screws or nails, all of the gaps, joints, and seams of the intersecting individual drywall boards, must be sealed by applying a first coat of compound to the intended joint and then a paper tape is embedded onto the first coat. Then the first coated is coated with joint compound in several successive layers. After drying and sanding each layer the wall achieves the smooth, even and finished appearance. The first layer is usually accomplished with hand trowels, which are similar to lath and plaster process used for same effect on a finished wall. However, applying the correct amount of joint compound with trowels, takes a significant degree of skill in order to avoid using too little compound creating air gaps. Although this trowel process is still acceptable for smaller projects, it is too slow for large projects such as an entire home or office.

In recent years automatic mechanical devices that apply the compound to the tape from a tube filled with compound, and which holds a tape roll near the top have been developed. This tube would act as a reservoir for the compound and as a handle that allowed the operator to extend their reach to high ceilings and apply the combined two components to the drywall joints. The operator, would then automatically cuts the tape expelled from it which coated with compound to the proper length in one step.

They are often referred to in the drywall trade as "Bazookas", which was so named by one of the pioneer company in the development of this type taping mechanism. However, this type device is very expensive for the average person who wants to do their own dry wall tape application process. U.S. Pat. No. 7,766,065 (Verhaar) discloses a small device that attach to bucket of compound that deliver pre-coated tape for the same purpose. The tape from a roll, hung from the device at the top of a bucket of joint compound where it is keep dry, would travel through a series of guide pins and rollers to the bottom. Then guided from the bottom of a bucket back up to the operator where it would be coated with compound. The operator would then cut and remove the necessary amount of pre-coated tape and attach it to the wall joint. The major problem associated with this device is the difficulty in using as the semi wet tape may prematurely break, while being pulled through or out of the device.

U.S. Pat. No. 4,652,331 (Plasencia) discloses a tape and adhesive applicator for dry wall taping has an adhesive dispensing nozzle adapted to be mounted on a caulking gun and an applicator roll mounted adjacent the outlet of the nozzle.

US Pat No. 2001/0003563 (Schauer et al) discloses an apparatus for the application of joint compound onto a taped drywall joint. The applicator uses an electrically powered, positive displacement pump which supplies a continuous flow of compound from a hopper to the applicator head via a fluid path.

U.S. Pat. No. 5,882,691 (Conboy) discloses an automatic dry wall applicator having an applicator head connected to a translucent body with a quick release mechanism for easy cleaning and a gas spring dispensing system which moves a piston head in the body to dispense joint compound.

U.S. Pat. No. 3,260,638 (Cleon) discloses a dry wall taper and mastic applicator comprising an elongated mastic-receiving barrel, a mastic-ejecting piston slidably mounted in said barrel, a housing mounted on one end of said barrel and having rear and forward walls, top and bottom walls, and side walls forming a mastic-receiving chamber communicating with the interior of said barrel.

U.S. Pat. No. 4,358,337 (Johnson et al) discloses a tape applicator and mastic dispenser for dry wall taping comprising a holder for a replaceable cartridge, means for forcing mastic material from said cartridge through a discharge outlet onto a tape, tape advancing means for feeding a tape from a supply roll beneath the discharge outlet.

U.S. Pat. No. 4,080,240 (Dysart) discloses an applicator for dispensing a tape coated with an adhesive compound onto a dry wall, particularly along the abutting margins of the dry wall panels, the applicator including a housing containing a reel from which the tape is dispensed, and a chamber through which the tape passes, the chamber having a distributor nozzle which applies a joint compound to the tape.

Although these prior art devices generally serve their purpose, they nonetheless each have limitations that affect their overall usefulness. For example, some of the devices require an attachment mechanism for operating or an electrically powered pump for continuously supplying the compound. These features add to the cost of equipment needed to perform a drywall operation. Still others are devices that combine the tape dispensing and compound containing functions, requiring the repeated transfer of compound from the container into the dispenser of the dispensing device.

Thus, it would be desirable to have a handheld drywall tape applicator device attached to a drywall smoothening knife that is easy and quick to use, simple to manufacture and overcome the problems associated with prior art devices.

SUMMARY

The present inventive subject matter describes a drywall tape applicator device for uniformly applying joint compound to both sides of a pre-cut dry wall tape of desired length, without being scraped clean of the required necessary amount of compound when the drywall tape is pulled through the device.

It is an objective to provide a hand-held dual functional device, including a drywall tape applicator for uniformly applying a joint compound to a drywall tape and a smoothening blade for smoothening the embedded tape with excess joint compound.

It is also an objective of to provide an improved method to pre-apply joint compound to a drywall tape for the direct application to the intersecting drywall joint.

It is another objective to provide an improved hand-held dual functional device including a drywall applicator attached to a smoothening device and the slot of the drywall applicator operative by a spring or hinged mechanism controlled by the user.

Yet another objective to provide a drywall tape dispenser that allows for even application of joint compound to both sides of a section of drywall tape, regardless of the amount of joint compound in the compound container and to preserve the excess scrapped off joint compound in the container for further use.

Still another objective is to provide a drywall tape dispenser that can be used to apply drywall tape to either flat surfaces or corners formed by adjacent pieces of drywall.

Another objective is to provide a drywall tape applicator that provides an even coating of joint compound to a pre-cut piece of drywall tape. The invention further avoids the inadvertent scraping of joint compound from the drywall tape regardless of the angle at which the tape is pulled from the dispenser Another objective is to provide a protrusion gate to guide the drywall tape into a slot with ridges and to be held securely by a user before dipping in a container of joint compound. And then once the drywall tape has been coated with the joint compound the user pulls the tape out through the slot to obtain a uniform coating of joint compound on both the sides. In one embodiment the slot has linear structure, while in other embodiments the slot can have a U-shaped or V-shaped structure. In yet another embodiment the slot opening is adjustable.

It should be understood that the summary above is provided to introduce in simplified form a selection of examples that are further described in the detailed description. It is not meant to identify key or essential features of any claimed subject matter that may later claim priority to the present description. Furthermore, the scope of any such claimed subject matter would not be limited to implementations that solve any disadvantages noted above or contained herein.

BRIEF DESCRIPTION OF THE DRAWINGS

Many aspects of the present invention can be better understood with reference to the following drawings. The components in the drawings are not necessarily to scale, emphasis instead being placed upon clearly illustrating the principles of the present inventive subject matter. Moreover, in the drawings, like reference numerals designate corresponding parts throughout the several views.

REFERENCE CHARACTERS

Figure 1:
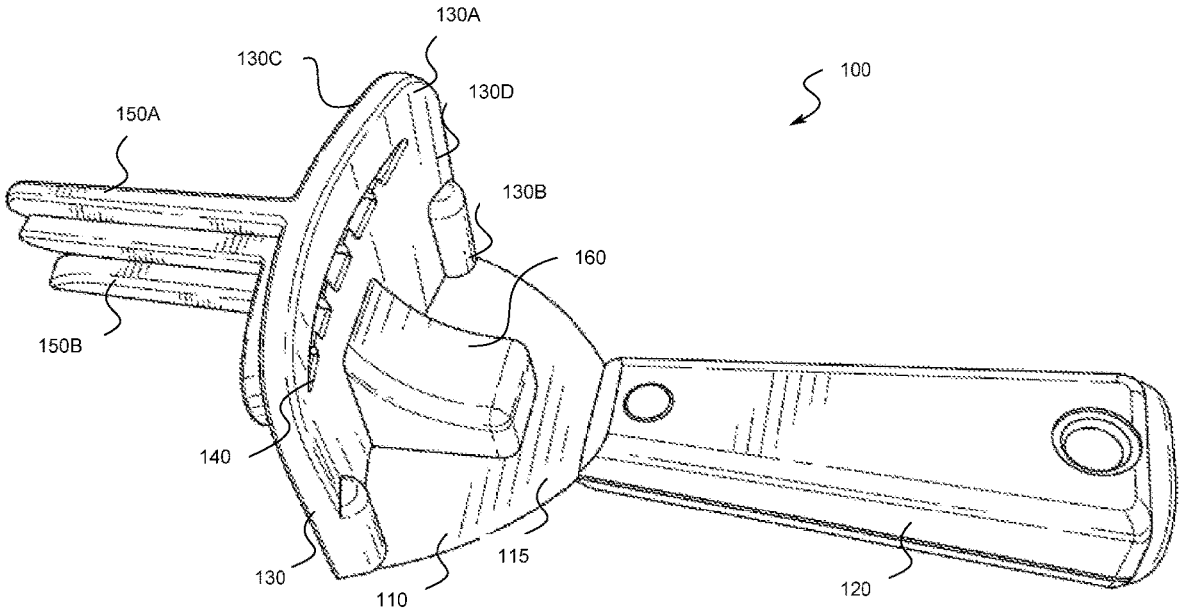
FIG. 1 illustrates a perspective view of a device according a first embodiment.

100: Dry wall tape applicator device
110: Base plate
120: Handle
130: Guiding Structure
130A and 130B: Upper and Lower portion of guiding structure
130C and 130DB: Front face and back face of guiding structure
140 A/B: Slot
150: Vertical protrusion gate
150A: Upper protrusion gate
150B: lower protrusion gate
160: Thumb support
205: Front side view of device
305: Left side view of device
400: Illustrates user using the device
415: Drywall tape
505: Top side view
570: Smoothening blade
575: Bottom surface
605: Bottom side view
705: Back side view
740: Slot
740A: Slot ceiling
740B: Slot floor
780: Connection mechanism
785: Lever
790A: Pivoting mechanism
790B: Latching mechanism
800-850: Illustrates method steps

DETAILED DESCRIPTION

The embodiments in this disclosure, as illustrated in FIGS. 1 through 8 and described in the specification below, may be adapted for use with drywall tape applicator device of different sizes and made of different material characteristics, including, but not limited to, the description below.

Existing methods of finishing a drywall consists of three distinct steps or coats, a drywall tape coat, a drywall fill coat and a finishing drywall coat. The first coat, or "tape coat", is an initial thin coat of joint compound applied onto a drywall joint, which is later covered with a drywall tape. The second coat of joint compound, or "fill coat", is applied after the "tape coat" has dried with a wider putty knife, creating a thin secondary coat. The final step in finishing drywall is called the "finish coat" and is the application of another layer of joint compound with a very wide drywall knife, 10-12". Thus, the finished dry wall is now all prepared for sanding and priming.

An embodiment is as illustrated in FIG. 1, a hand-held drywall tape applicator device 100 is an improvement over prior art taping device and methods. The device is operative to apply an appropriate amount of joint compound to both sides of a pre-cut strip of drywall tape and then to directly place the drywall tape with the applied joint compound in a desired location at a drywall joint formed by two adjacent drywalls without the necessity of a tape coat on the joints. Thus, saving more extraneous efforts for a professional or a novice user, regardless of their skill level. The drywall tape applicator device 100 is a single hand-held device, independent of any other attachments or mechanisms or moving parts required for its operation. Thus, avoiding many of the inherent problems associated with the prior art descriptions of the tape dispenser designs related to complexity and high costs.

In one embodiment, the drywall applicator device 100 comprises a base plate 110 that may be attached to a handle 120, for convenient handling by a user. In other embodiments the base plate 110 with its handle 120, may be detachably mounted at a tangential angle onto a container containing joint compound for a convenient use of the drywall applicator device 100.

Further, the dry wall applicator device 100 includes a guiding structure 130 attached orthogonally nearer to the handle end 115 of the base plate 110. Other embodiments might include a guiding structure 130 that is manufactured as part of the base plate 110, or ones that comprise a variety of means of attachment. For example, the base plate might comprise screws, clamps or other like fasteners to permit secure placement of the guiding structure 130 on the base plate 110. Other exemplary embodiments include a guiding structure 130, which is flat and planar or having a curved structure orthogonal to the base plate 110, for ergonomic convenience. Such variations on the guiding structure design are obvious to those skilled in the art and not considered to be limiting with respect to the operation of the inventive subject matter.

The guiding structure 130 further includes an upper section 130A and a lower section 130B. The upper section 130A of the guiding structure 130, hosting a slot 140 for feeding the pre-cut dry wall tape. The slot 140 is gated by a vertical protrusion gate 150 on a front face 130C of the guiding structure 130 facing away from the handle 120. The vertical protrusion gate 150 includes, an upper protrusion gate 150A and a lower protrusion gate 150B for guiding the pre-cut dry wall tape into the slot 140. The lower section 130B of the guiding structure 130, hosting a thumb support 160 on a rear face 130D of the guiding structure 130, facing towards the handle 120. The user intending to use the drywall tape applicator device 100, while holding the handle 120 may conveniently place his/her thumb on the thumb support 160.

Figure 2A:
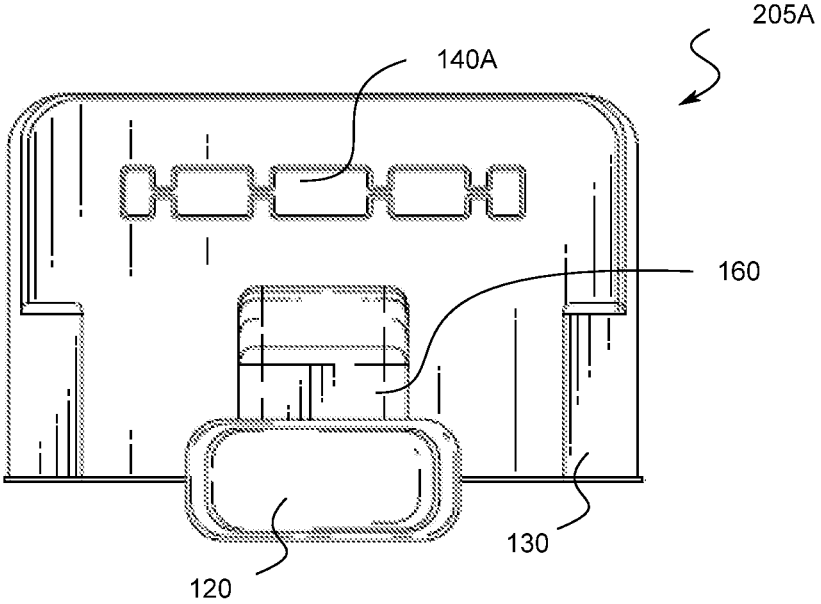
FIGS. 2A and 2B illustrates a front side view of the device.
Figure 2B:
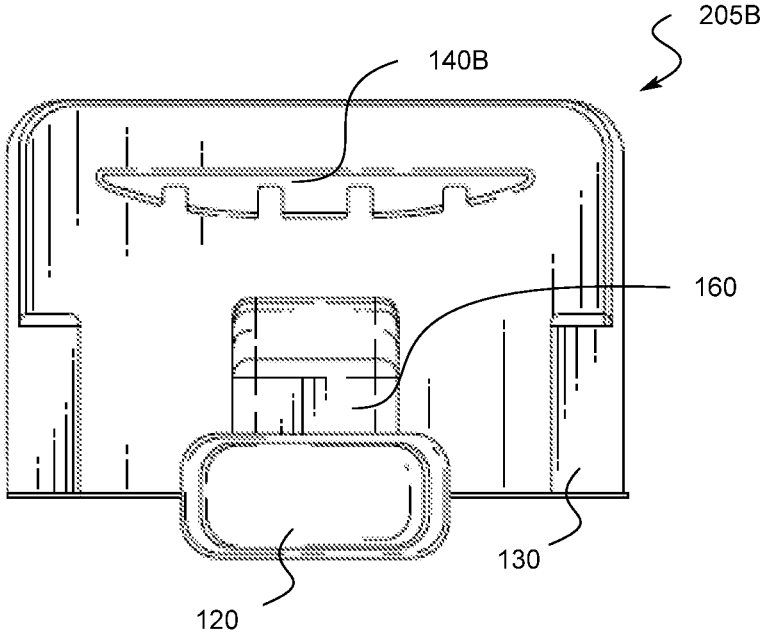
Figure 3:
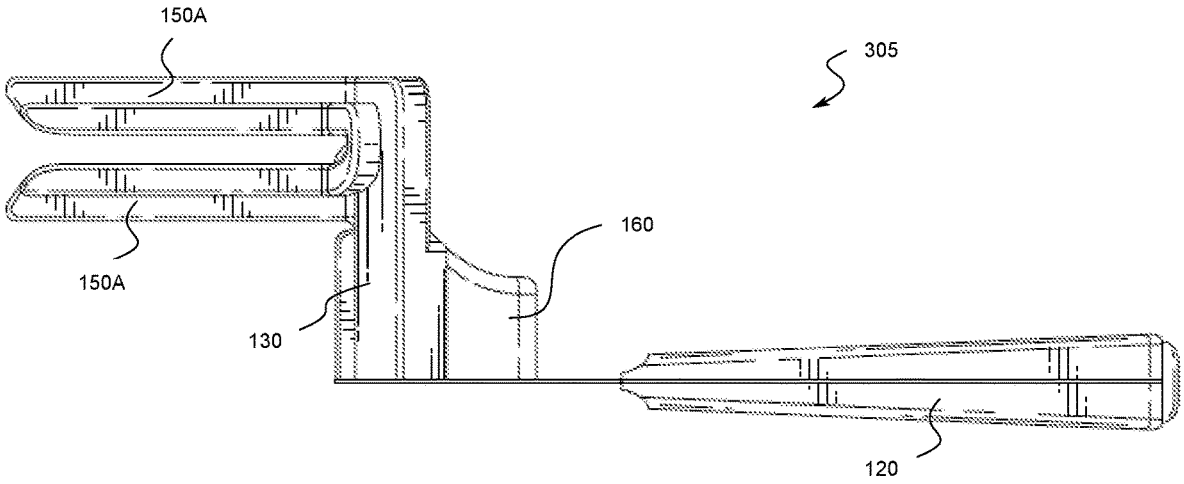
FIG. 3 illustrates a left side view of the device.

Referring to FIG. 2A, 2B and FIG. 3, FIGS. 2A and 2B illustrates a front-side view 205A, 205B and FIG. 3 illustrates a left side view 305 respectively, of the drywall tape applicator device 100. The slot 140A as illustrated in FIG. 2A includes a ridged ceiling and ridged floor with uniformly spaced ridges. In other embodiments the ridged slot 140B may include a flat ceiling with a ridged floor as shown in 205B of FIG. 2B.

The vertical gate protrusions 150A and 150B as illustrated in FIG. 3, help in guiding a pre-cut dry wall tape into the slot 140A/B by a user. As illustrated in FIGS. 2A and 2B, the slot 140A/B in the guiding structure 130 comprises an opening of dimensions sufficient to permit the easy withdrawal of the drywall tape, along with the adhering joint compound, from the drywall tape applicator device 100 by a user. The opening is of sufficient width to accommodate the width of the drywall tape being used, and is made of such a depth that a desired amount of joint compound remains adhering to the drywall tape as the tape is withdrawn from the slot 140. Thus, in an exemplary embodiment the dimensions of the protrusion gate 150, ridged slot 140 of the drywall tape applicator device 100 is adapted for use with standard width (approximately 2" wide) drywall tape. In yet other embodiments the slot 140 may include a rectangular or a triangular structure, U-shaped structure or a V-shaped structure or any multiple angled structure falling within the scope of the inventive subject matter. The differently shaped ridged slots make way for bending the drywall tape at a desired line in the plane of the drywall tape to be more appropriate for fixing to corners or step structured dry wall joints.

Figure 4:
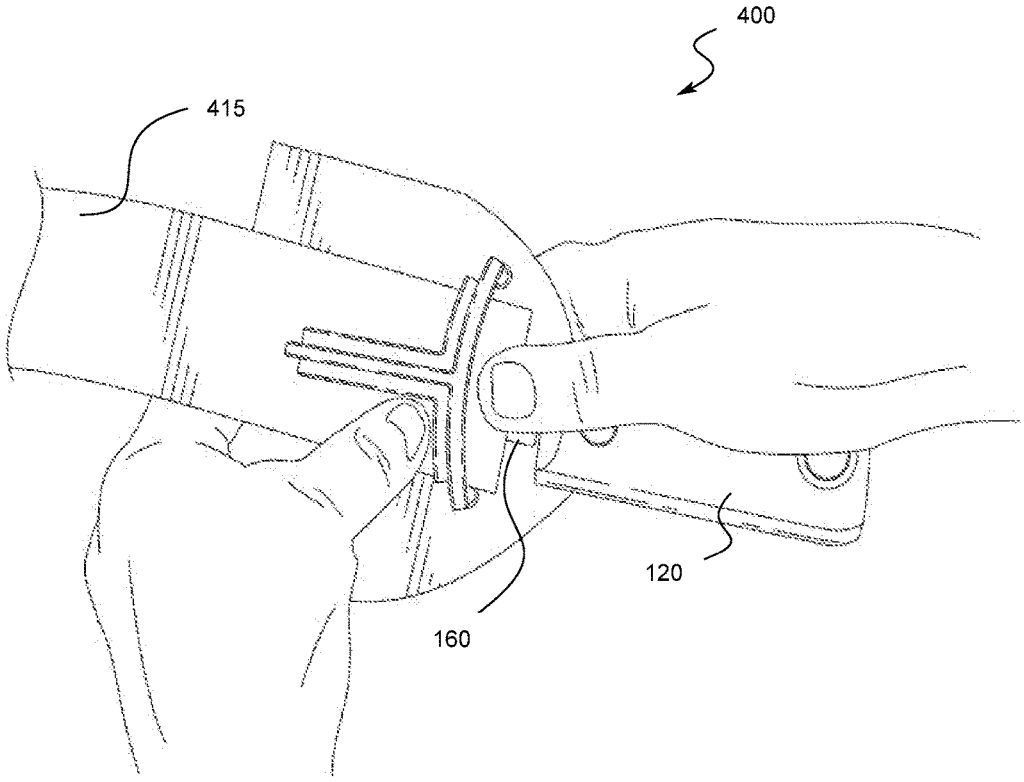
FIG. 4 illustrates user using the device.

Referring to FIG. 4, FIG. 4 illustrates a user using 400 the drywall tape applicator device 100. The user inserts a drywall tape 415 through the ridged slot 140 (not seen in FIG. 4) while holding the handle 120 and simultaneously securing a portion of the dry wall tape in its position by placing his/her thumb on the thumb support 160. The user then immerses the dry wall tape applicator device 100 with the inserted drywall tape 415 in a container containing joint compound. The user then pulls the drywall tape out of the device through the slot 140, thereby an excess of the joint compound on the drywall tape 415 is scrapped and yet leaving necessary joint compound on both sides of the tape for adhering to a joint formed by two adjacent dry walls. Thus, avoiding any possible gaps of compound or air bubbles under the tape when it is applied, when attached to the drywall joint. It will also leave an ample amount of compound on top side to cover the drywall tape and to start the second coat. Also, the excess joint compound is received back in the container and preserved for further use.

Figure 5:
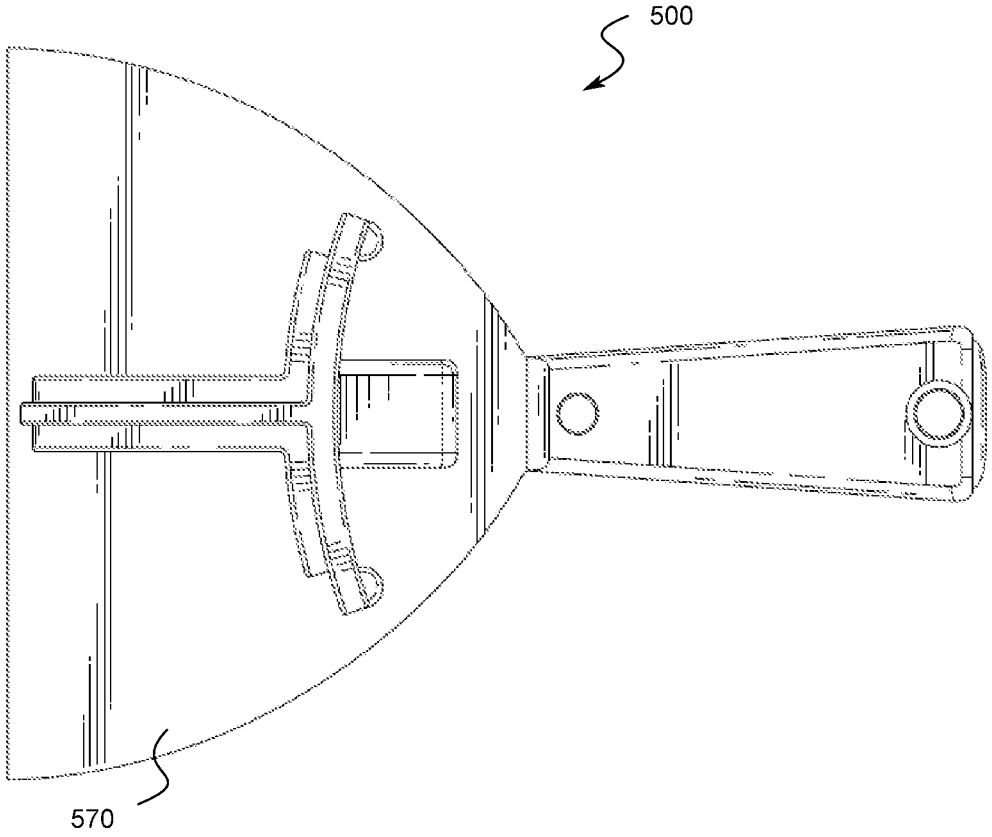
FIG. 5 illustrates a top side view of the device according a second embodiment.
Figure 6:
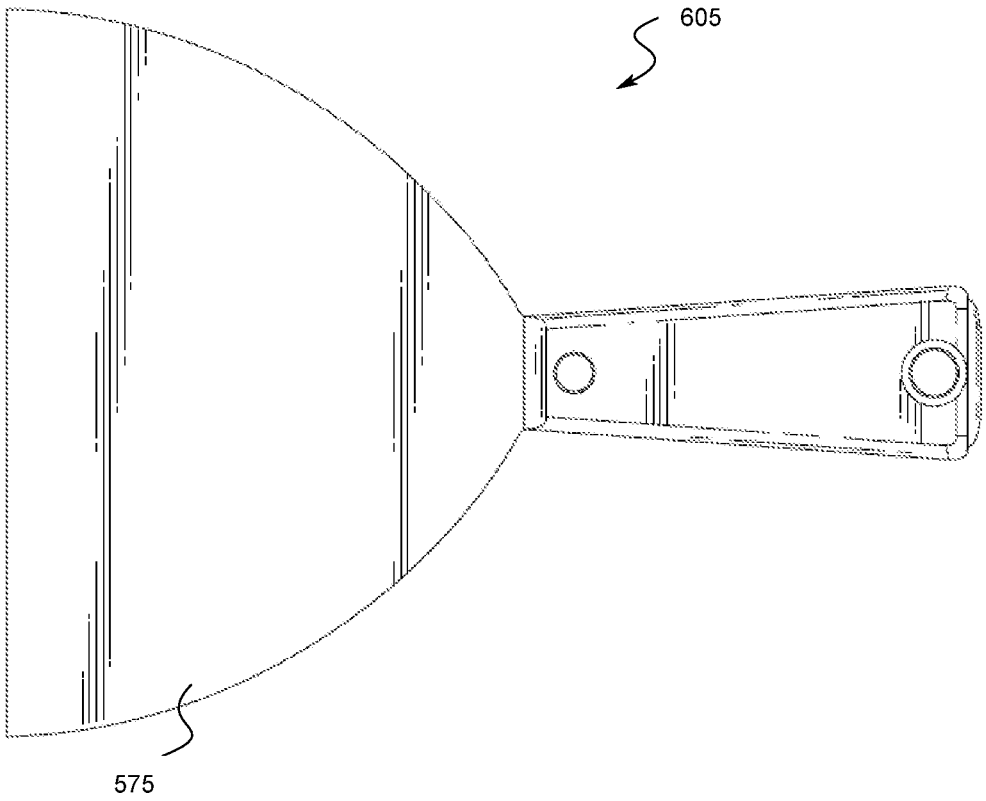
FIG. 6 illustrates a bottom-side view of the device.

In another embodiment a drywall tape applicator and smoothening device 500 is as illustrated in FIG. 5. The base plate 110 of the drywall tape applicator device 100 can be replaced with a pre-smoothening blade knife 570. A bottom side view 605 of the device 500 is as illustrated in FIG. 6, the flat smooth bottom surface 575 of the blade knife 570 allowing for a quick smoothening of the joint compound on the drywall, when the joint compound is still wet and pliable. A typical blade knife is 10-12 inches, but any dimensions as desired by the user and falling within the scope of the inventive subject matter may be employed. The drywall tape applicator and smoothening device 500 makes way for a combined, dual functional, hand-held device to accomplish both tasks of applying compound to the drywall tape and smoothening out excess joint compound on the drywall, with the one device without stopping and switching back and forth to another tool. Thereby reducing the overall time required for finishing a drywall by 60%, when compared to time taken by conventional methods.

In an embodiment the drywall tape applicator and smoothening device 500 is completely made of sturdy plastic material or the drywall tape applicator is made of plastic material but the smoothening knife is made of steel for having a smooth surface. The drywall tape applicator and the smoothening knife can be made of any suitable material falling within the scope if the inventive subject matter.

Figure 7A:
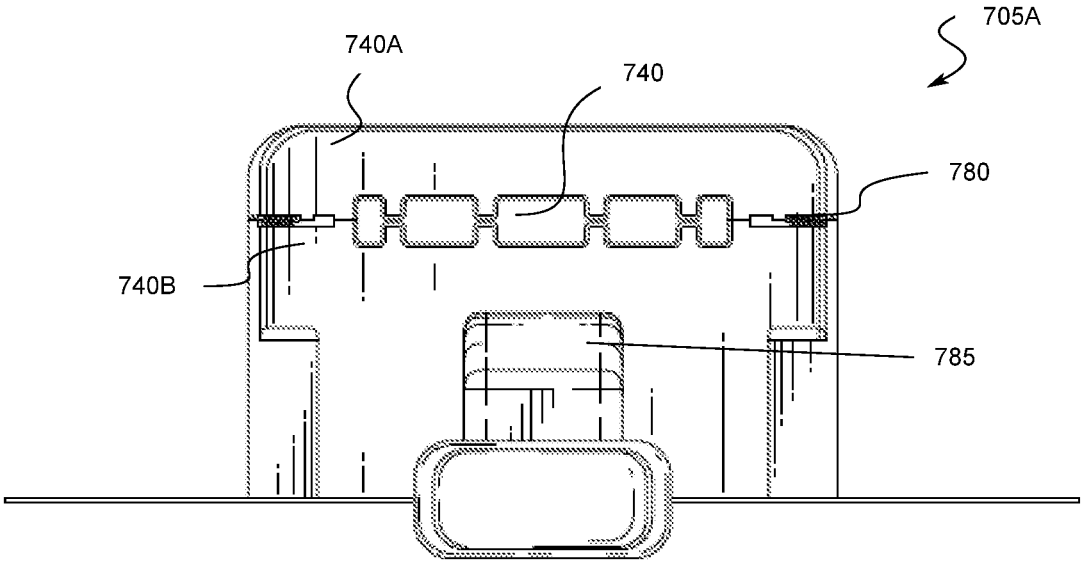
FIGS. 7A and 7B illustrates a top side view of the device according a third embodiment.
Figure 7B:
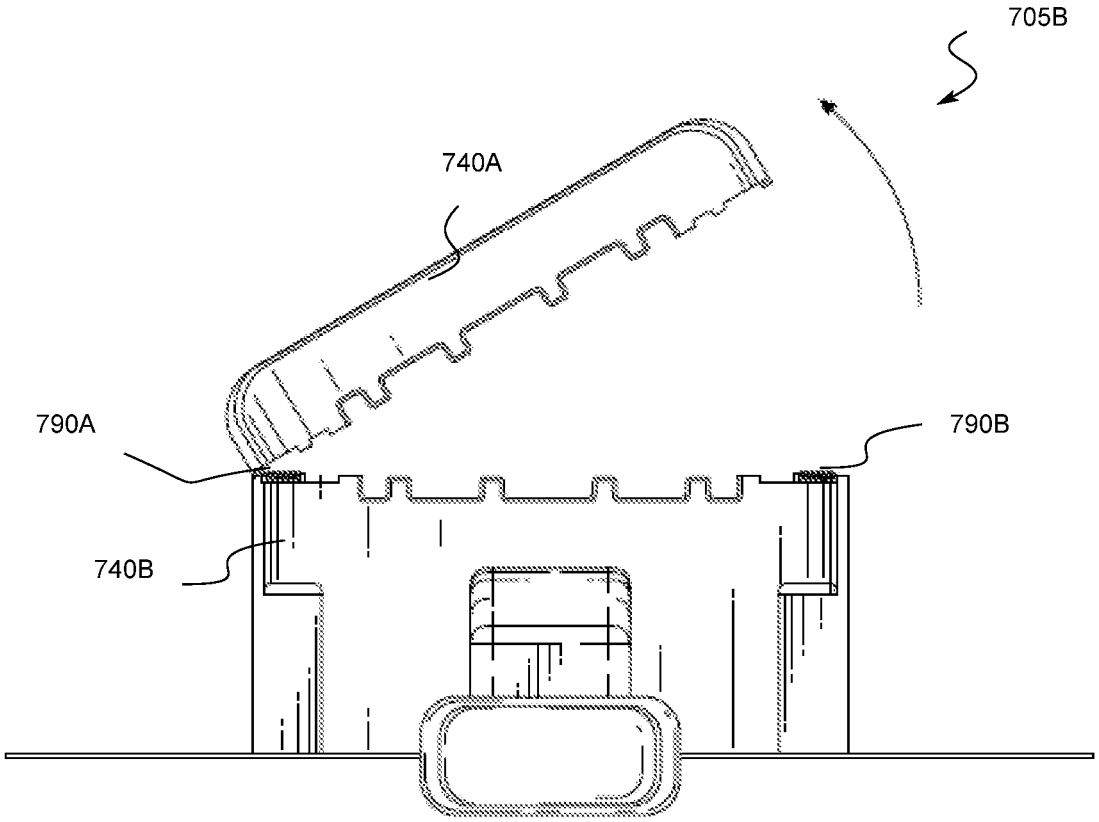

In yet another embodiment as illustrated in front view FIG. 7A, a dry wall tape applicator 705A includes a ridged slot 740, which is horizontally partitioned to a top portion 740A and a bottom portion 740B connected by a connection mechanism 780. The connection mechanism 780 includes but not limited to hinge connection mechanism or spring connection mechanism. The connection mechanism 780 operative by a lever 785 is controlled by the user with his/her thumb and helps in accommodating drywall tape of variable thickness and yet maintaining the necessary spacing between the top portion 740A and the bottom portion 740B for the drywall tape to be coated with joint compound on both the sides when pulled through the slot 740. In other exemplary embodiments, as illustrated in front view FIG. 7B, a dry wall tape applicator 705B includes the connection mechanism at one end of the opening of the slot being replaced with a pivoting connection mechanism 790A and the connection mechanism at the other end being replaced by a latching fastening mechanism or 790B. The pivoting connection mechanism 790A helps in opening and closing of the upper portion 740A to conveniently accommodate the drywall tape of variable thickness and the slot is secured back to its closed position by the latching or fastening connection mechanism 790B.

Figure 8:
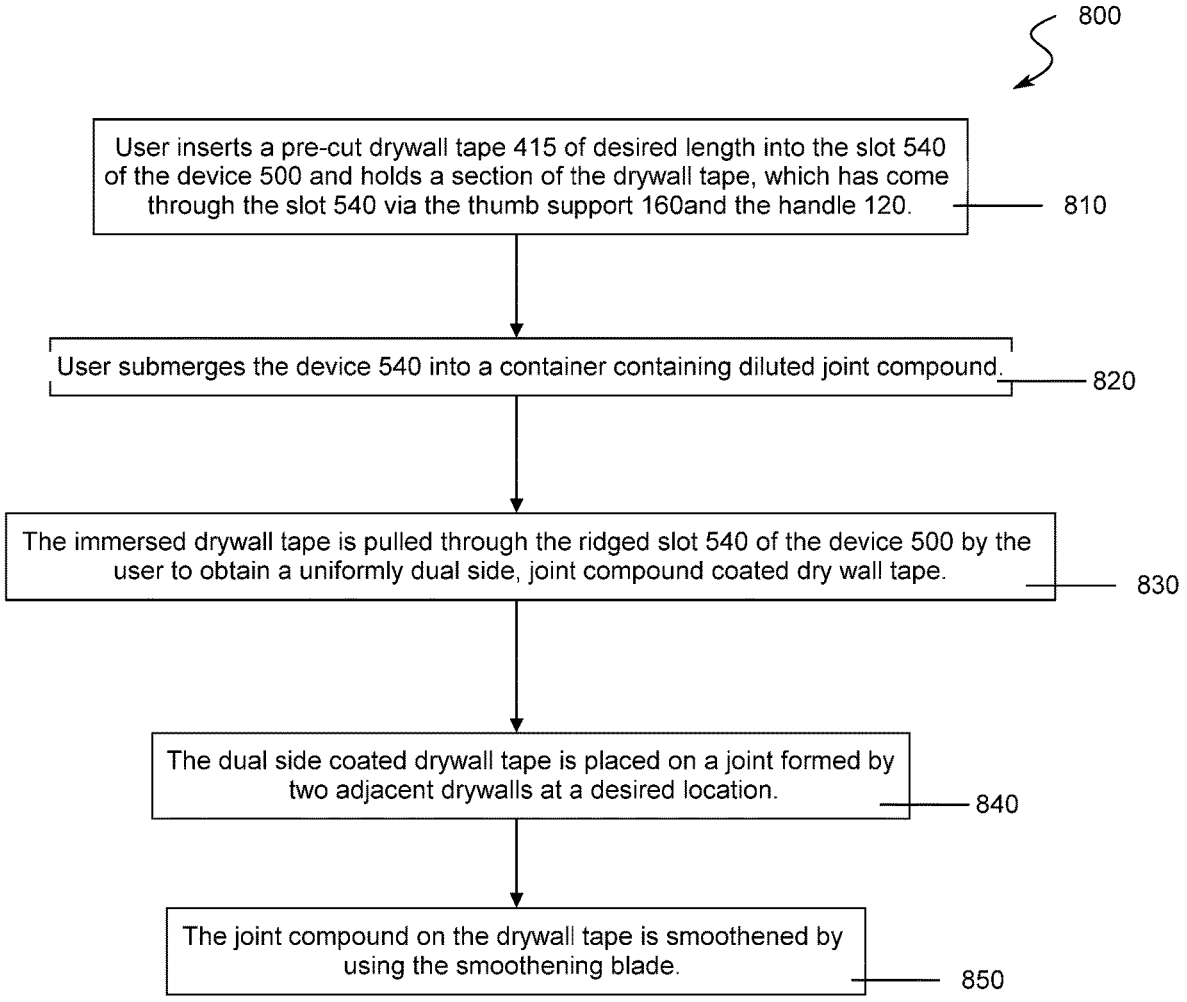
FIG. 8 illustrates steps describing the method of use of the device.

Referring to FIG. 8, FIG. 8 illustrates method steps 800 for using the hand held combined tool for drywall taping including a drywall tape applicator attached to a smoothening blade 500 as described in FIG. 5 and FIG. 6. At step 810, a user inserts a pre-cut drywall tape of desired length into the slot 540 of the device 500 and holds a section of the drywall tape, which has come through the slot 540 via the thumb support and the handle. The next step 820 involves to submerge the device 540 into a container containing diluted joint compound. Later at step 830, the drywall tape is pulled through the ridged slot 540 of the device 500 by the user to obtain a uniformly dual side, joint compound coated dry wall tape. In the following step 840, the dual side coated drywall tape is placed on a joint formed by two adjacent drywalls at a desired location. In the final step 850, the joint compound on the drywall tape is smoothened by using the smoothening blade.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

The invention claimed is:

1. A drywall tape applicator device comprising:

a drywall tool including a handle, a base plate or a smoothening blade having a tape-feeding side and a joint-compound-smoothening side, the drywall tool in operable use with the drywall tape applicator device; and a drywall tape guide removably coupled to the tape-feeding side of the base plate or the smoothening blade and disposed in a perpendicular relationship to the tape-feeding side of the base plate or the smoothening blade between the base plate or the smoothening blade and a thumb support, the drywall tape guide comprising:

a tape-feeder slot formed within a frontward side and through a rearward-side of the drywall tape guide; and a pair of tape-pulling protrusions, each extending from the frontward side towards the base plate or the smoothening blade of the drywall tool, the pair of tape-pulling protrusions disposed one on top of another with the tape-feeder slot disposed between each of the pair of tape-pulling protrusions;

wherein the drywall applicator device is operable independent of attachments.

2. The drywall tape applicator device as claimed in claim 1, wherein the tape-feeder slot leaves behind a thin coating of joint compound on both a first side and a second side of a piece of pre-cut drywall tape, as the piece of pre-cut drywall tape with an excess coating of joint compound is pulled through the tape-feeder slot of the drywall tape guide from an end of the base plate or smoothening-blade towards a handle end of the drywall tool onto a seam formed between an intersecting drywall joint formed between two or more drywall panels.

3. The drywall tape applicator device as claimed in claim 2, wherein the tape-feeder slot comprises a set of upper ridges extending in a direction towards the base plate or the smoothening blade from a first surface of the tape-feeder slot in symmetrical contact with a set of lower ridges extending in a direction towards the first surface from a second surface of the tape-feeder slot.

4. The drywall tape applicator device as claimed in claim 2, wherein the tape-feeder slot comprises a substantially flat first surface.

5. The drywall tape applicator device as claimed in claim 1, wherein the rearward side of the drywall tape guide comprises a concavity having an inward curve toward a center point of the drywall tape guide.

6. The drywall tape applicator device as claimed in claim 1, wherein the tape-feeder slot comprises a first portion and a second portion.

7. The drywall tape applicator device as claimed in claim 6, wherein the first portion and the second portion of the tape-feeder slot are pivotally connected by a hinge on a first end of the first portion and the second portion.

8. The drywall tape applicator device as claimed in claim 7, wherein the hinge comprises a spring.

9. The drywall tape applicator device as claimed in claim 8, wherein the first portion and the second portion of the tape-feeder slot are lockable by a latch on a second end of the first portion and the second portion.

10. The drywall tape applicator device as claimed in claim 9, wherein the first portion of the tape-feeder slot is pivotally rotatable from the first end of the second portion of the tape-feeder slot.

11. The drywall tape applicator device as claimed in claim 1, wherein the drywall tape guide is formed to attach to the drywall tool of the drywall tape applicator device.

12. The drywall tape applicator device as claimed in claim 1:

wherein the base plate or the smoothening blade is made of steel; and wherein the drywall tape applicator device, excepting the base plate or smoothening blade, is made of a plastic material.

13. The drywall tape applicator device as claimed in claim 1, wherein the drywall tape applicator device is made of a plastic material.

14. The drywall tape applicator device as claimed in claim 1, wherein the drywall tape applicator device is independent of moving parts required for its operation.

* * * * *